US005438624A

United States Patent [19]

Lewiner et al.

[11] Patent Number: 5,438,624

[45] Date of Patent: Aug. 1, 1995

[54] PROCESSES AND DEVICES FOR PROTECTING A GIVEN VOLUME, PREFERABLY ARRANGED INSIDE A ROOM, FROM OUTSIDE NOISES

[75] Inventors: Jacques Lewiner, Saint-Cloud; Mathias Fink, Meudon, both of France

[73] Assignee: Jean-Claude Decaux, France

[21] Appl. No.: 163,508

[22] Filed: Dec. 9, 1993

[30] Foreign Application Priority Data

Dec. 11, 1992 [FR] France ..... 92 14952

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,683,590 | 7/1987 | Miyoshi et al. | 381/94 |
| 5,216,721 | 6/1993 | Melton | 381/71 |
| 5,216,722 | 6/1993 | Popovich | 381/71 |
| 5,233,540 | 8/1993 | Andersson et al. | 381/71 |

FOREIGN PATENT DOCUMENTS

| | | |
|---|---|---|
| 0510864 | 4/1993 | European Pat. Off. . |
| 2191063 | 3/1992 | United Kingdom . |
| 92/20063 | 1/1992 | WIPO . |
| 0505949 | 9/1992 | WIPO . |

OTHER PUBLICATIONS

Journal of the Acoustical Society of America, vol. 90, No. 2, Aug. 1991, "Iterative Time Reversal Mirror: A Solution to Self-Focusing in the Pulse Echo Node", C. Prada et al.

*Primary Examiner*—Forester W. Isen

*Attorney, Agent, or Firm*—Larson and Taylor

[57] ABSTRACT

To protect a volume (2) arranged inside a room (3) in regard to outside noises E, use is made of an array of acoustic sensors (11$_j$) receiving the noise E and arranged a distance A from the volume and of an array of acoustic sources (15$_k$) arranged a distance B less than A from the volume and signals S are applied to these sources, these signals being summations of the double convolution products of the function $E_j(t)$ with two functions $f_{ij}(t)$ and $g_{ik}(-t)$ which are directly deducible from the impulse responses gathered, on the one hand, at the sensors (11$_j$) from pulses emitted by the sources (10$_i$) carried by a fictitious barrier (6) delimiting the volume and, on the other hand, at sensors (12$_i$) stationed at the same places as these latter sources (10$_i$), from pulses emitted by the above sources (15$_k$).

7 Claims, 1 Drawing Sheet

FIG. 1.
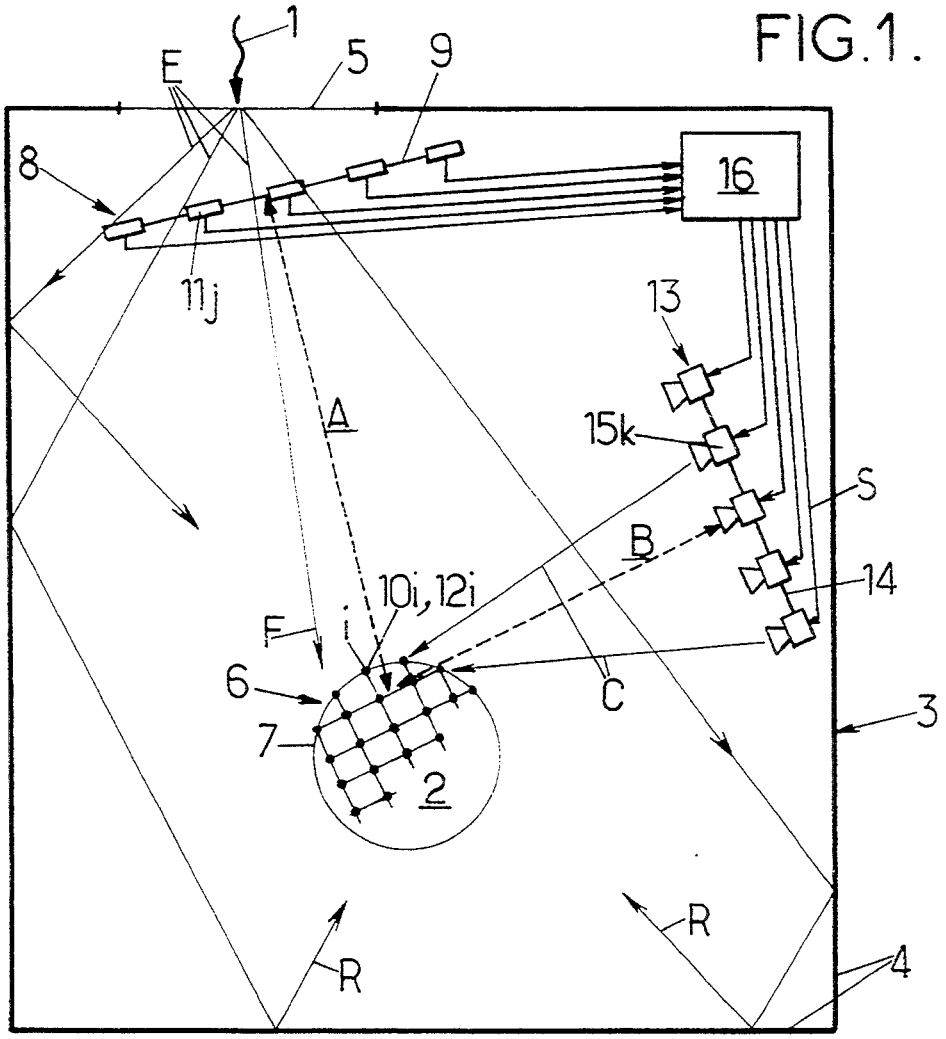
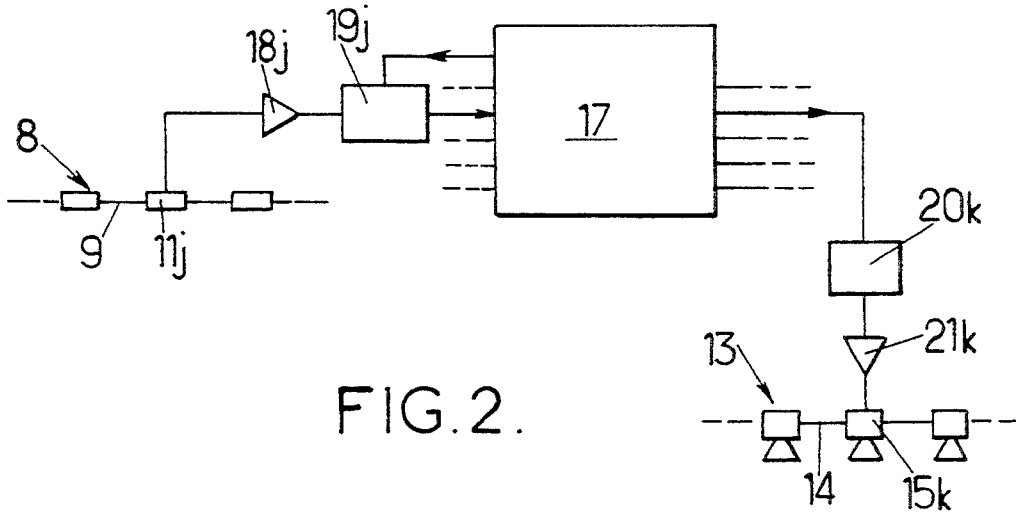
FIG. 2.

PROCESSES AND DEVICES FOR PROTECTING A GIVEN VOLUME, PREFERABLY ARRANGED INSIDE A ROOM, FROM OUTSIDE NOISES

It is often desired to protect certain volumes with regard to noises generated outside these volumes.

The volumes in question are in particular those intended to be occupied by the head of an individual, in particular when in a seated position or lying position: when the desired acoustic protection is obtained, the individual concerned is sheltered from outside acoustic nuisance as long as his head remains stationed inside such a volume.

In order to ensure such acoustic protection, it has already been proposed to interpose phonically insulating partitions between the volumes in question and the outside of the latter.

The insulation obtained with such partitions is limited and the physical obstacles embodied by the said partitions are often crippling.

It has also been proposed to cancel certain sounds received by such volumes by applying to the said volumes "counter-noises" of identical amplitude and opposite phase to those of the said sounds.

However hitherto this type of cancellation, sometimes dubbed active attenuation, has led to encouraging results only for relatively pure sinusoidal sounds transmitted directly from their source to the volume to be protected.

In particular, it has not been possible to deal correctly with random noises in this way and, when the volumes considered lie inside rooms, delimited laterally by partitions, below by a floor and above by a ceiling, it has hitherto scarcely been possible to control the phenomena of reflection or reverberation of noises to be cancelled on the various walls delimiting the said rooms as well as on the other obstacles, such as furniture, present in these rooms.

The aim of the invention is above all to remedy all these disadvantages by enabling a volume arranged inside a room to be protected in regard to noises of any nature produced outside this room, and in particular from certain favoured directions corresponding for example to windows.

To this end, the devices for acoustic protection of limited volumes according to the invention are essentially characterized in that they comprise, on the one hand, arranged respectively at two distinct distances A and B from a same reticulate fictitious array defining points i arranged in the volume to be acoustically protected, an array of acoustic sensors (microphones) receiving the noises to be cancelled $E_j(t)$ and an array of acoustic sources (loudspeakers), the distance B being less than the distance A, and on the other hand, an electronic circuit interposed between the said sensors and the said sources and configured so as to calculate, in time spans less than A−B/V, v being the speed of sound in air, for each noise $E_j(t)$, a plurality of signals $S_k(t)$ which are applied instantaneously, respectively, to the sources, each signal $S_k(t)$ being equal to:

$$S_k(t) = -\sum_i \sum_j E_j(t) \oplus f_{ji}(t) \oplus g_{ik}(-t),$$

a formula in which:

each function $f_{ji}(t)$ is identical to the reciprocal function $f_{ij}(t)$ which is the impulse response, determined and recorded beforehand, corresponding to the noise generated at the sensor of index j of the above array of sensors through the emission of a short acoustic pulse from a source assumed stationed at the point i, and each function $g_{ik}(-t)$ is calculated from the function $g_{ik}(t)$ which is itself identical to the reciprocal function $g_{ki}(t)$, which is in turn the impulse response, determined and recorded beforehand, corresponding to the noise generated at a sensor assumed stationed at point i from the emission of a short acoustic pulse by the source of index k of the above array of sources.

In preferred embodiments, use is made moreover of one and/or the other of the following provisions:

the detection of the noises $E_j(t)$ required for calculation of the signals S is performed by sampling at a rate corresponding substantially to one eighth of the shortest period characterizing the sound waves to be processed, that is to say to the highest frequency of the range selected for the sensitivity of the sensors, the spread of frequencies to which the sensors are sensitive is included between 10 and 10,000 Hz, the number of acoustic elements making up each of the arrays is equal to several tens, being especially of the order of 50 to 100 and the distances which mutually separate these elements within each array is of the order of a decimeter, the difference between the distances A and B is of the order of 1 meter;

each signal $S_k(t)$ is equal to:

$$S_k(t) = -\sum_j E_j(t) \oplus h_{jk}(t),$$

in which formula $h_{jk}(t)$ is a function determined and recorded beforehand equal to:

$$h_{jk}(t) = \sum_i f_{ij}(t) \oplus g_{ik}(-t).$$

The invention also addresses the specially designed arrays of acoustic elements for equipping the above devices, as well as the processes for determining the impulse responses $f_{ij}(t)$ and $g_{ki}(t)$ which are used for the calculation of the signals S.

These processes are essentially characterized according to the invention in that, in proximity to the volume to be acoustically protected there is arranged, in such a way as to define a portion at least of this volume, a reticulate array defining a plurality of points i at which are stationed:

in a first time span, acoustic sources, the responses $f_{ij}(t)$ then being determined in the vicinity of the above permanent sensors during the emission of short acoustic pulses by the said sources, and in a second time span, acoustic sensors, the responses $g_{ki}(t)$ then being determined in the vicinity of these sensors during the emission of short acoustic pulses by the above permanent sources.

Within at least one of the two source-sensor assemblies used in the course of the two successive "time spans" respectively of the processes defined above, the respective roles and locations of the sources and sensors could be interchanged.

In the case wherein the use of the function $h_{jk}(t)$ above is envisaged, a prior step of calculation and recording of this function $h_{jk}(t)$ is furthermore undertaken.

The invention comprises, apart from these main provisions, certain other provisions which are preferably used at the same time and which will be appraised more explicitly hereafter.

In what follows a preferred embodiment of the invention will be described whilst referring to the attached drawing, of course in a non-limiting manner.

FIG. 1, of this drawing, shows very diagrammatically a room equipped with a device suitable for protecting a limited volume of this room from outside noises.

FIG. 2 is a diagram of the electronic circuit included with this device.

It is proposed to protect a relatively limited volume 2 arranged inside a room 3 delimited laterally by partitions 4, below by a floor and above by a ceiling, in regard to random noises E shown diagrammatically with the arrow 1.

The noises E are for example those which originate from outside the room through an open or closed window 5.

The volume 2 has for example the shape of a sphere or a cylinder of revolution whose diameter is of the order of 1 meter and whose central part is intended to be occupied by the head of a person whom it is desired to insulate from the noises E, this person being for example seated in front of a desk or lying in a bed.

To solve the problem posed, use is made of the technique known per se of active attenuation which consists, in order to protect a given point in regard to troublesome noises, in creating counter-noises at this point which are opposite to the said noises and are determined in such a way that their addition to these noises at the said point produces in the latter a zero resultant, that is to say eliminates the said noises.

The embodiments which have been proposed in this sector hitherto have only proven satisfactory when the two following conditions were met:

makeup of the noise by a pure sinusoidal sound such as that emitted by certain motors or musical instruments, exclusive and direct propagation of the said sound from its source to the point to be protected, without reflection or reverberation of this sound on obstacles such as the walls of a room.

The present invention proposes to solve the problem of the attenuation, or even elimination, of the undesirable noises in the volume 2 defined above, doing so even if these noises are random and are reflected or reverberated by the walls 4 of the room 3.

To this end, the following is undertaken.

Two "barriers" or "arrays" 6 and 8 each composed of distinct acoustic elements, the latter kept separate from one another by a rigid framework (7, 9 respectively) latticed in regard to the sounds, are interposed between the volume 2 to be acoustically protected and the source of the noises E in regard to which it is desired to ensure the said protection.

These two barriers or arrays 6 and 8 are spaced apart from each other by a mean distance A.

The first 6 of these two arrays defines a reticulate network, in general three-dimensional, of distinct points or "nodes" i−1, i, i+1 . . . occupying at least partially the volume 2 to be acoustically protected.

The acoustic elements which it includes are, in a first time span, acoustic sources (loudspeakers or others) $\mathbf{10}_{i-1}$, $\mathbf{10}_i$, $\mathbf{10}_{i+}$. . . which are located at the said nodes.

As regards the acoustic elements comprising the second barrier 8, they are sensors (microphones) $\mathbf{11}_{j-1}$, $\mathbf{11}_j$, $\mathbf{11}_{j-1}$ . . . which are located at various points or "nodes" j−1, j, j+1 . . . of the said barrier.

Next, there is determined, as a function of the time t, each of the impulse response laws $f_{ij}(t)$ corresponding to each of the noises generated at each sensor $\mathbf{11}_j$ by the emission of a short acoustic pulse from each source $\mathbf{10}_i$.

The reciprocity theorem is recalled here according to which the impulse response $f_{ij}(t)$ as defined above is exactly identical to the inverse impulse response $f_{ji}(t)$ which would be gathered by sensors assumed to be arranged at exactly the same locations i as the above sources $\mathbf{10}_i$ in response to the emission of short acoustic pulses from sources assumed to be arranged at the various points j as replacement for the above sensors $\mathbf{11}_j$.

This reciprocity takes account in particular of all the reflections or reverberations of acoustic waves by the walls of the room 3 or by other obstacles contained in this room, such as furniture, which reflections are shown diagrammatically on the drawing by the lines R.

By applying the said theorem, the resultant noise which would reach each of the points i of the array 6 is computed for each given global noise $E_j(t)$ received at each of the points j.

This resultant noise is the convolution product $E_j(t) \ominus f_{ji}(t)$.

The total noise $F_i(t)$ which would reach each of the points i in response to the noises $E_j(t)$ received by the set of points j is then determined, these noises being precisely those symbolized with the arrow 1 above.

This total noise $F_i(t)$ is equal to:

$$F_i(t) = \sum_j E_j(t) \oplus f_{ji}(t). \tag{I}$$

Each of the sources $\mathbf{10}_i$ of the array 6 is then replaced by acoustic sensors $\mathbf{12}_i$ arranged at exactly the same locations i as these sources.

A third barrier or array 13 of the same kind as the previous ones is arranged substantially at a distance B from the middle region of the array 6, B being a length less than A: this array 13 consists of a rigid framework 14 keeping spaced apart from each other a plurality of acoustic sources $\mathbf{15}_{k-1}$, $\mathbf{15}_k$, $\mathbf{15}_{k+1}$ . . . located at distinct points or "nodes" k−1, k, k+1 . . . of the said framework.

Next, each impulse response $g_{ki}(t)$ is determined, corresponding to the noise which is generated at the sensor $\mathbf{12}_i$ by the emission of a short acoustic pulse from the source $\mathbf{15}_k$.

By virtue of the reciprocity theorem recalled above, each function $g_{ki}(t)$ is strictly identical to the reciprocal function $g_{ik}(t)$.

Consequently, it may be stated that the global noise $G_k(t)$ which would be created at each of the points k of the array 13 in response to the noises $F_i(t)$ assumed to be emitted from the points i by sources located at these points, would be equal to:

$$G_k(t) = \sum_i F_i(t) \oplus g_{ik}(t). \tag{II}$$

This formula is valuable since it makes it possible to determine extremely accurately the noises which would result, in the vicinity of the array 13, from producing the noises $F_i(t)$ in the vicinity of the various points i of the first array 6.

Now, the latter noises $F_i(t)$ are precisely those which are generated in the vicinity of the said points i by applying the undesirable noises $E_j(t)$ to be cancelled to the room 3.

In order to calculate the desired counter-noises intended for cancelling any irritation from the undesirable incident noises $E_j(t)$ in the vicinity of these points i, that is to say to nullify or at least greatly attenuate the noises $F_i(t)$ created in the vicinity of the points i from these undesirable noises, it suffices:

- to replace the variable (t) by the variable (−t) as variable in the response law $g_{ik}(t)$ coming into the formula II above,
- and to apply the opposite signal $S_k(t)$ of each resultant signal to the corresponding sources $\mathbf{15}_k$.

It is in fact found that, if counter-signals $g_{ik}(-t)$ are emitted at each of the points k, the corresponding wave emitted towards the point i propagates in a manner which is exactly the inverse of that corresponding to the emission of a short acoustic pulse from the said point i towards the said point k, and this wave is therefore focused at the point i, exactly reconstructing thereat the said short pulse, despite the various distortions of the wave fronts which may have been occasioned in the two directions by the various acoustic reflections due to the walls and other obstacles of the room.

More precisely, the inverse wave front corresponding to these counter-signals occupies in succession the various positions occupied in the past by the initial "direct" wave front, the phenomenon observed being comparable to the projection of a cinematographic film backwards.

The signals $S_k(t)$ in question may then be regarded as given by the formula below:

$$S_k(t) = -\sum_i\sum_j E_j(t) \oplus f_{ji}(t) \oplus g_{ik}(-t). \quad \text{(III)}$$

The application of these signals $S_k(t)$ to the sources $\mathbf{15}_k$ makes it possible to generate in the vicinity of the points i counter-noises C—or $C_i(t)$—which are capable of nullifying the noises $F_i(t)$ produced at these points by the undesirable noises $E_j(t)$.

The volume 2 then remains silent and inaccessible to the said noises $E_j(t)$, regardless of their nature and intensity and regardless of the reflections or reverberations experienced by some of their components before reaching the said volume.

Of course, after having determined the impulse response laws $g_{ki}(t)$, the array 6 can be entirely eliminated, thus completely freeing the approaches to the acoustically insulated volume 2.

This is an important advantage of the present invention.

To obtain the desired cancelling of each noise $F_i(t)$, the counter-noises C should reach the vicinity of the points i at the same time as these noises.

This is where the difference between the two distances A and B separating the array 6 from the arrays 8 and 13 respectively comes in.

Care is taken that this difference is sufficient for it to be possible to calculate the counter-noises electronically during the time that the sounds take to travel the length A−B.

It is found that, if this length is of the order of a meter, the resulting time (3 milliseconds) is quite sufficient for the said electronic calculation.

This is one of the original observations which has made possible the conception of the present invention.

The electronic circuits in question have been represented by the rectangle 16 in FIG. 1.

They have been detailed somewhat more in FIG. 2 wherein is seen a storage and computation unit 17 connected:

- on the one hand, to each of the acoustic sensors $\mathbf{11}_j$ by a chain comprising an amplifier $\mathbf{18}_j$ and an analog/-digital converter $\mathbf{19}_j$,
- and, on the other hand, to each of the sources $\mathbf{15}_k$ by a chain comprising a digital/analog converter $\mathbf{20}_k$ and an amplifier $\mathbf{21}_k$.

In practice, the noises $E_j(t)$ which are recorded by the sensors $\mathbf{11}_j$ are not utilized in a continuous manner.

Sampling is undertaken at a rate corresponding substantially to one eighth of the shortest period characterizing the sound waves to be processed, that is to say to the highest frequency of the range selected for the sensitivity of the sensors.

The spread of frequencies to which the sensors are sensitive is advantageously included between 10 and 10,000 Hz.

Under these conditions the highest frequency being 10 kHz, which corresponds to a period of 100 microseconds, the sampling frequency is equal to 80 kHz which corresponds to one sampling carried out every 12 microseconds.

As regards the distances separating the various acoustic elements of the same array or barrier, these distances are advantageously given a value equal to half the smallest wavelength of the range of frequencies concerned.

Thus, the distance in question can be of the order of 10 centimeters, which ensures especially good acoustic protection in respect of the low frequency components of the noises to be cancelled: the wavelength is in fact 33 centimeters for a frequency of 1000 Hz.

As regards the number of acoustic elements making up each of the barriers or arrays, this number is equal to several tens, being in particular of the order of 50 to 100.

The convolution products, of these various numbers, which come into the formula III above are then relatively high, which may imply the use of relatively powerful computing facilities.

To this end, a digital signal processor (DSP) could be assigned to each of the sensors $\mathbf{11}_j$.

According to an advantageous improvement which will now be described, the necessary electronic labour can be considerably simplified.

This improvement is based on the following considerations.

Formula III above can also be written:

$$S_k(t) = -\sum_j E_j(t) \oplus \sum_i f_{ij}(t) \oplus g_{ik}(-t). \quad \text{(IV)}$$

Denoting the right hand side of this convolution by $h_{jk}(t)$ (that is to say $$h_{jk}(t) = \sum_i f_{ij}(t) \oplus g_{ik}(-t)),$$

the formula IV becomes:

$$S_k(t) = -\sum_j E_j(t) \oplus h_{jk}(t). \quad \text{(V)}$$

This formula is relatively simple in that it no longer involves any of the points i.

Naturally, these points i are involved during calculation of the function h.

However, this calculation can be performed beforehand in the course of a preparatory step followed by the placing of the calculated function h into memory, this being much more flexible than the previous solution.

In practice, the process is as follows:

to begin with, each impulse response $f_{ij}(t)$ is measured over a period of time T commencing from time t=0 corresponding to the emission of the short initial acoustic pulse from the point i, the said period extending sufficiently to contain the whole of the relevant impulse response, corresponding both to the direct path and to the spurious reflections, each impulse response $g_{ki}(t)$ is similarly measured over the same period T, the two functions thus measured are supplemented with 0s over the two periods extending from $t=-\infty$ to time t=0 and from time t=T to time $t=-\infty$, respectively, the "inverse" function $g_{ik}(-t)$ is calculated and stored, the function $$h_{jk}(T) = \sum_i f_{ij}(t) \oplus g_{ik}(-t),$$

is computed, the functions h thus computed are stored, noting that they are symmetric in jk since the two impulse responses $f_{ij}(t)$ and $g_{ik}(t)$ are themselves symmetric in ij and ik respectively, finally the noises $E_j(t)$ to be cancelled are convolved, in accordance with formula IV above, with the function $h_{jk}(t)$ thus stored so as to determine the opposite signals $S_k(t)$.

In order to demonstrate the advantages afforded by the improvement just described a numerical example is given below, of course purely by way of non-limiting illustration of the invention:

the array 8 comprises a network of 8×8 points j, namely 64 points J, similarly the array 13 comprises a network of 8×8 points k, namely 64 points k, the array 6 comprises a cubic three-dimensional meshed network of 8×8×8=512 points i, the time T is equal to 100 ms, sampling is performed at a rate of 100 kHz, this corresponding to a number of 10,000 samples for each readout, and the resolution of each sample is 12 bits, which corresponds to 1.5 bytes: each readout therefore involves 15,000 bytes.

If the general formula III given above is utilized directly, each of the impulse responses $f_{ij}(t)$ and $g_{ik}(-t)$ must be placed in memory, namely in total 64×512=32768 readouts for each of the two families: if account is taken of the symmetry, the number can be halved in all, which still corresponds to a number of readouts greater than 16,000 for each family.

The convolution product of these two families of impulse responses and the double convolution product of the said product with the function representative of the noises $E_j(t)$ entail the use of powerful computers.

In the case of the improvement described above, the preparatory step of calculating and storing the function h involves the summation of 512 convolution products $f_{ij}(t) \oplus g_{ik}(-t)$ from i=1 to i=512: the result of this summation, which constitutes the function h, is stored then the step of actual creation of the counter-noises S needs merely to involve the determination of the function h thus stored for each of the pairs of variables jk, that is to say, accounting for the symmetry of the system in jk, for a total number of such pairs of the order of 2,080 only.

In the end, the storage to be performed for the actual implementation of the invention comprises 2,080×15,000 bytes, that is to say 31,20 megabytes, which represents an entirely reasonable number.

To sum up, it may be stated that:

on completion of the preparatory phase, for the numerical example adopted, the number of functions to be stored is of the order of 2,000 only whereas it was of the order of 32,000 according to the general formula, and, if the convolution product to be performed is regarded in each case as admitting two factors the first of which is $E_j(t)$, the second factor is defined by some 2,000 functions in the first case whereas, in the general case, it involves some 16,000×16,000=256 million functions.

Accordingly, and regardless of the embodiment adopted, a device is finally obtained which makes it possible efficaciously to protect a given volume from outside noises, a device whose construction and operation follow sufficiently from the foregoing.

This device has, in relation to the formerly known devices, numerous advantages and in particular that of ensuring acoustic protection even in regard to random noises and even if the relevant volume is arranged inside a room whose walls have not been specially treated to oppose acoustic reflections.

As is self-evident, and as moreover already follows from the foregoing, the invention is in no way limited to those of its modes of application and embodiments which have more especially been envisaged; it embraces, on the contrary, all the variants thereof, in particular, those in which the microphones 11*j* and/or the loudspeakers 15*k* used to create the counter-noises are not the same as those used beforehand to calibrate or set up the installation when the array 6 is present, in which case the appropriate corrective factors are introduced into the computations in order to take account of the differences between the responses of the apparatuses used, those in which the variable phenomenon created by the loudspeakers and/or that measured by the microphones is not a pressure, but a speed of air molecules, in which case the appropriate corrective factors are introduced into the computations, the switch from one of these variables to the other being achieved by temporal differentiation or integration, and those in which, in the course of the calculation of one at least of the functions f and g, roles and locations of the sources and sensors are interchanged with respect to those utilized above: indeed, in view of the reciprocity theorem recalled above, the function $f_{ij}(t)$, being equal to $f_{ji}(t)$, can be calculated equally well by employing short acoustic pulses emitted from the various points i and by analysing the corresponding impulse responses at points J or by employing short acoustic pulses emitted from the various points j and by analysing the corresponding impulse responses at the points i; in particular, the stationing of just acoustic sources at the points i could be envisaged in order to determine all the impulse responses $f_{ij}(t)$ and $g_{ik}(t)$, the sources $\mathbf{15}_k$ then being replaced by sensors at points k for determining the responses g.

We claim:

1. A device for protecting from outside noises a given volume arranged inside a room, said device comprising an array of acoustic sensors receiving noises to be canceled, an array of acoustic sources, said arrays being arranged at two distinct distances, A and B, respectively, from said volume, the distance B being less than the distance A, and an electronic circuit, at least partly interposed between said sensors and the said sources, for calculating, in time periods less than (A−B)/v, whereas v is the speed of sound in air, for each noise received by a sensor, a plurality of signals which are applied instantaneously, respectively, to the sources, so as to provide canceling of said noise in said volume, said electronic circuit comprising means for determining impulse response laws of the room corresponding to emissions of short acoustic pulses, for storing said response laws, for determining counter signals deduced from said response laws by time inversion, for storing said counter signals, and for forming convolution products of some of said response laws, some of said counter signals and some of the signals received by the sensors.

2. A process for protecting from outside noises a given volume arranged inside a room, said volume being defined by a reticulate array of points i, arranged in the volume, by using a device comprising an array of acoustic sensors receiving noises $E_j(t)$ to be canceled, an array of acoustic sources, said arrays being arranged at two distinct distances, A and B, respectively, from said volume, the distance B being less than the distance A, and an electronic circuit, at least partly interposed between said sensors and the said sources, for calculating, in time periods less than (A−B)/v, whereas v is the speed of sound in air, for each noise $E_j(t)$ received by a sensor, a plurality of signals $S_k(t)$ which are applied instantaneously, respectively, to the sources, so as to provide canceling of said noise in said volume, said electronic circuit comprising means for determining impulse response laws of the room corresponding to emissions of short acoustic pulses, for storing said response laws, for determining counter signals deduced from said response laws by time inversion, for storing said counter signals, and for forming convolution products of some of said response laws, some of said counter signals and some of the signals received by the sensors, the process comprising providing that each of the signals $S_k(t)$ which are applied to the sources from the electronic circuit is equal to:

$$S_k(t) = \sum_i \sum_j E_j(t) \oplus f_{ji}(t) \oplus g_{ik}(-t),$$

a formula in which:

each function $f_{ji}(t)$ is identical to the reciprocal function $f_{ij}(t)$ which is the impulse response, determined and stored beforehand, corresponding to the noise generated at the sensor of index j of said array of sensors through the emission of a short acoustic pulse from a source assumed stationed at a point i, and each function $g_{ik}(-t)$ is calculated from the function $g_{ik}(t)$ which is itself identical to the reciprocal function $g_{ki}(t)$, wherein $g_{ki}(t)$ is the impulse response, determined and stored beforehand, corresponding to the noise generated at a sensor assumed stationed at point i, from the emission of a short acoustic pulse by the source of index k of said array of sources.

3. A process according to claim 2, wherein detection of the noises $E_j(t)$ required for calculation of the signals $S_k(t)$ is performed by sampling at a rate corresponding substantially to one eighth of the shortest period characterizing the sound waves to be processed, and thus to the highest frequency of the range selected for the sensitivity of the sensors.

4. A process according to claim 2, wherein each signal $S_k(t)$ is equal to $$S_k(t) = -\sum_j E_j(t) \oplus h_{jk}(t),$$

wherein $h_{jk}(t)$ is a function, determined and stored beforehand, equal to:

$$h_{jk}(t) = \sum_i f_{ij}(t) \oplus g_{ik}(-t). \tag{3}$$

5. A process according to claim 2, wherein, during a first time period, acoustic sources are stationed at said points i of said reticulate array, with the responses $f_{ij}(t)$ then being determined in the vicinity of the sensors of the array of sensors during the emission of short acoustic pulses by the acoustic sources stationed at said points i, and during a second time period, acoustic sensors are stationed at said points i, with the response $g_{ki}(t)$ then being determined in the vicinity of the sensors stationed at points i during the emission of short acoustic pulses by the sources of the array of sources.

6. A process according to claim 5, wherein in at least one combination of the sources and sensors used during said first and second time periods, the respective roles and locations of those sources and sensors are interchanged.

7. A process according to claim 2, wherein a reticulate array of acoustic elements is used to carry out the process and the acoustic elements are kept separate from one another by a rigid framework latticed with respect to sounds.

* * * * *